United States Patent [19]

Schrade

[11] 4,223,798

[45] Sep. 23, 1980

[54] CAN FOR PRESERVING FOODSTUFFS AND PROCESS FOR ITS MANUFACTURE

[75] Inventor: Jean Schrade, Zurich, Switzerland

[73] Assignee: Swiss Aluminium Ltd., Chippis, Switzerland

[21] Appl. No.: 48,689

[22] Filed: Jun. 14, 1979

[30] Foreign Application Priority Data

Jul. 6, 1978 [CH] Switzerland ..... 7368/78

[51] Int. Cl.[3] ..... B65D 6/34; B65D 8/04; B65D 8/08

[52] U.S. Cl. ..... 220/66; 220/67; 220/73

[58] Field of Search ..... 220/66, 67, 69, 73, 220/75, 80, 83, 309, 85 K, 79

[56] References Cited

U.S. PATENT DOCUMENTS

| | | | |
|---|---|---|---|
| 3,072,517 | 1/1963 | Gaylord | 220/67 X |
| 3,403,813 | 10/1968 | Price | 220/67 X |
| 3,543,996 | 12/1970 | West | 220/67 X |
| 3,709,398 | 1/1973 | Fuhrmann | 220/67 |
| 3,750,827 | 8/1973 | Wick | 220/66 X |
| 3,955,705 | 5/1976 | Dubois et al. | 220/73 X |
| 4,011,819 | 3/1977 | Kessler | 264/273 X |
| 4,023,700 | 5/1977 | Buguet et al. | 220/67 X |

*Primary Examiner*—Steven M. Pollard
*Attorney, Agent, or Firm*—Bachman and LaPointe

[57] ABSTRACT

This invention relates to a can for preserving foodstuffs and a process for its manufacture.

The can which can be closed and sealed by means of conventional machines and sealing methods comprises a basically cylindrical can body of an aluminum-plastic composite which is joined permanently at one end directly to a can bottom and at the other end to a metal lid via a metal ring which is flanged to the said lid.

The process of the invention comprises the combination of the following steps:

(a) Affixing the bottom to the body made of an aluminum-plastic composite.

(b) Affixing the metal ring to one end of the body by means of an adhesive and applying pressure and elevated temperature to produce welding or sealing.

(c) Flanging a metal lid onto the metal ring affixed to the can.

20 Claims, 7 Drawing Figures

FIG. 1
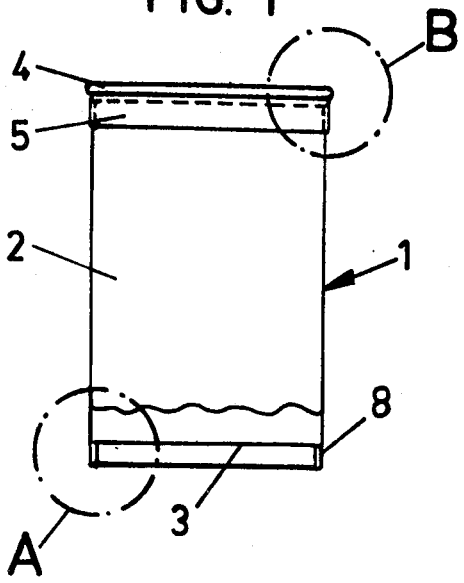
FIG. 2
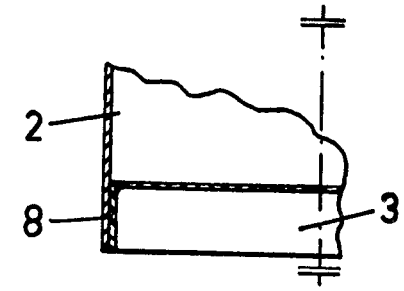
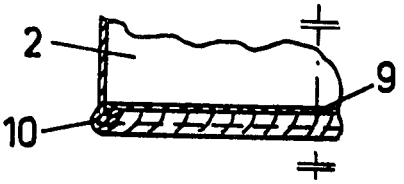
FIG. 3
FIG. 4
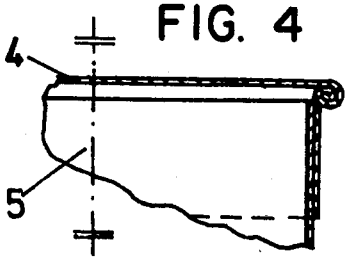
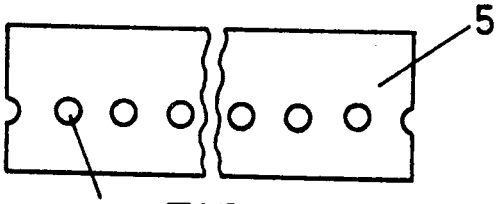
FIG. 5
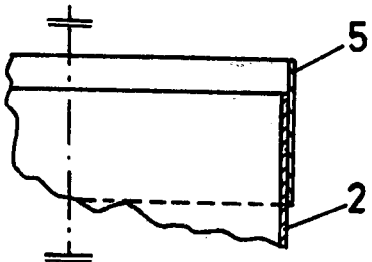
FIG. 6
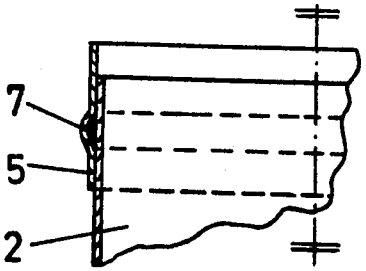
FIG. 7

CAN FOR PRESERVING FOODSTUFFS AND PROCESS FOR ITS MANUFACTURE

BACKGROUND OF THE INVENTION

The invention relates to a can for preserving foodstuffs and a process for its manufacture, the body of which is basically cylindrical in shape and has a top and a bottom part permanently affixed to it.

Cans made from tin plate and used for preserving sterilizable foodstuffs over periods of several years have been known now for more than a century.

The metal tin, which provides the corrosion protection for the iron (steel) in tin plate, is one of the chemical elements which occurs in the Earth's crust in very small quantities. The relatively large amount of tin plate used for cans has now led to the situation where tin is already one of the metals giving problems as a result of its lack of abundance. Furthermore, it is also relatively expensive, for example four times as expensive as copper.

Aluminum, which is one of the most abundant elements in the Earth's crust, would be suitable for the manufacture of cans, if the aluminum sheet for this purpose had the same thickness as can material usually has, and would be therefore not significantly more expensive than the conventional cans made of tin plate. Certain plastics would also be suitable for the manufacture of cans, both with respect to mechanical properties and price. What is of disadvantage however in the case of plastic cans is that their physical and chemical structure is permeable to gases and aromas, which means that foodstuffs can not be stored unchanged in plastic cans for extended periods.

It has not been found that it is technically and economically feasible to make cans out of so-called aluminum-plastic composites and that these cans completely fulfil the requirements made of such cans both with respect to price and the preservation of foodstuffs.

The object of the present invention is to provide a can for the preservation of foodstuffs and a process for the manufacture of such cans by means of which the above mentioned disadvantages of the conventional cans are avoided.

SUMMARY OF THE INVENTION

The object is achieved by way of the invention in that the body of the can, made out of an aluminum-plastic composite, is joined permanently at one end to a bottom part and at the other end to a metal lid via a metal ring flanged to the said lid.

The process for manufacturing the can is characterized by the combination of the following steps:

(a) Affixing the bottom part to the body which is made out of an aluminum-plastic composite.

(b) Affixing the metal ring (5) to one end of the body (2) by means of an adhesive and applying pressure and elevated temperature to produce welding or sealing.

(c) Flanging a metal lid onto the metal ring affixed to the can.

BRIEF DESCRIPTION OF THE DRAWINGS

Further advantageous forms of the cans in terms of the invention will now be described with the help of drawings which show two exemplified embodiments in a simplified schematic manner viz., FIG. 1: A front view of a can representing a first exemplified embodiment of the invention, shown here with the lower part sectioned.

FIG. 2: A section through the bottom part of the can which is circled with the broken line A in FIG. 1, but shown here on a larger scale.

FIG. 3: A section through a part of the bottom of a can representing a second exemplified embodiment.

FIG. 4: A section through a part of the lid of the can and the edge where the lid and the sidewall meet i.e. the part of the can in FIG. 1 which is circled with the broken line B, but shown here on a larger scale.

FIG. 5: A view of the form of a holding ring which, in a second version, is provided with holes at its edge.

FIG. 6: A section through the upper part of the can body which has a holding ring attached to it, the ring being the version of holding ring shown in FIG. 5.

FIG. 7: A section through the upper part of the can body which has a holding ring attached to it, the ring being a third version of holding ring.

DETAILED DESCRIPTION

As shown in FIGS. 1 to 7 the can 1 comprises a body 2 with a bottom 3 and lid 4 attached at the lower and upper ends respectively.

The can body 2, which is essentially cylindrical in shape, is made of an aluminum-plastic composite material. So that the conventional technology and machines used for closing cans with such bodies can be used further, a metal lid 4 of blank, tin and chromium plated, lacquered steel sheet or aluminum is chosen, and this in a form which is normal for closing the sheet metal cans known to date.

The bottom 3 can be made out of the same composite as the body 2, out of a different composite or out of metal. As shown in FIGS. 1 and 2, the composite material used in the bottom 3 is deep drawn and welded to the body 2 at the position indicated by the number 8. As FIG. 3 shows on the other hand the flat bottom 9, fitting into the inner contour of the can, is inserted into the space inside formed by the body 2 of the can, and welded onto the body by means of a toroidal shaped weld bead 10. The weld bead 10 can, for example, be produced by an injection molding method.

It was also found useful to affix a metal ring 5 to the upper end of the can body 2. The technology of this step has been developed in various ways in keeping with the terms of the invention, as can be seen from FIGS. 1, 4, 5, 6 and 7.

The metal ring 5 in FIG. 4 has been joined to the can body 2 by means of an adhesive and by employing pressure and an elevated temperature. This process can also be called welding or sealing. FIGS. 5 and 6 show a version where, in addition to using an adhesive, mechanical fixing is employed by pressing a ring and body together while warm, as a result of which molten material from the body flows into holes 6 provided in the ring where it then sets.

A third kind of connection between the metal ring 5 and the can body 2 can be seen in FIG. 7. In that case, instead of providing holes 6 to fix the ring 5 to the can body 2, the ring 5 has a ring-shaped channel 7 which is filled by known injection molding methods, with a material which adheres intimately both to the metal ring and to the can body.

The metal ring 5 can in principle be affixed to the inner or outer wall of the body 2. To secure the lid 4 in place with the help of the metal ring 5, it is first bent over at right angles. This can be done before or after the ring 5 has been fixed to the can body 2.

As has been mentioned already, the can body 2 is made in a conventional manner from an aluminum-plastic composite. Such a composite, made for cans in keeping with the invention, is less than 1 mm thick, the top layer of aluminum being about 0.05 mm. This is to say that the aluminum used is so-called thin strip—as it is generally called in connection with composite foil material.

It is known that aluminum foils are generally not pore-free unless thicker than ca. 20 μm. The limit is usually given by this thickness; thinner aluminum foil is not usable for the purpose in question. The aluminum foil on both sides can have the same or different thicknesses, however technically it is of no value to exceed a thickness of 0.1 mm. The aluminum foils can be treated on one or both sides e.g. degreasing, caustic etching, printing and/or coated with bonding agents, lacquers and/or adhesives.

Depending on the requirements, it can also be of advantage to prepare the sandwich composite in the reverse manner. This would give an aluminum foil coated on both sides with a layer of plastic. Such composites are produced by laminating pre-fabricated foils or by extruding a layer of plastic on both sides of a pre-treated aluminum foil using conventional machines for this purpose.

Depending on whether the composite is produced with the aluminum foil or the plastic on the surface, different requirements are made of the material.

(a) When the composite has aluminum as the outer layers, relatively little is required of the plastic with respect to compatability with foodstuffs, as the plastic does not come into direct contact with the contents when this composite is made up into a can. The resistance of the plastic towards the contents is therefore of minor significance. On the other hand, it is necessary to provide corrosion protection to the aluminum foil, which is in direct contact with the contents.

(b) When the composite has plastic on the surface, the aluminum foil is protected by the plastic layer from coming into direct contact with the contents. In this case therefore, the aluminum foil requires no additional corrosion protection. The plastic layer in the inside of the can must withstand the contents both during sterilization and during the subsequent years of storage, and must comply with the laws concerning food packaging laid down in the countries where the cans are filled and in countries where the contents are consumed.

The choice of plastic for the inside of the can is subject to greater limitation in case (b) than in case (a). On the other hand, version (b) can under certain circumstances be more economical than version (a). In both cases certain mechanical properties are required of the can body made out of a composite. These relate to the handling during filling, sterilizing, transportation and use. These requirements can be met only when the composite remains strongly intact over a long period of time. Certain plastics stick to aluminum without any adhesive; others must be bonded with the help of an adhesive. The appearance and form of the adhesive is not limited in this application, and therefore all known possibilities such as liquid, pasty, doughy, powdery, as a foil are admissible, as well as methods of application such as e.g. rolls, by immersion, by extrusion onto one or both of the surfaces to be stuck together. If, for example, polyolefins are used for the plastic layer, then the choice of adhesive is limited, whereby hetero-polymers (made e.g. by co-, ter- or grafted polymerization) from the olefin in question and an unsaturated acid such as e.g. acrylic acid have been shown to be good for this purpose. However, many single or multi-component adhesives such as e.g. isocyanate or epoxy type adhesives are also known and can be used.

The known methods for pretreating aluminum foil to give a lasting bond with the plastic e.g. thermal, mechanical, chemical are to be used as required.

A preferred combination for the composite comprises thin strip aluminum, 20 to 100 μm thick, preferably 30 μm thick coated on both sides—preferably with the help of an adhesive made of a hetero- or grafted polymer of propylene and acrylic acid—with a layer of 100 to 500 μm thick, preferably 200 μm thick polypropylene, whereby use is preferably made, on one or both sides, of a PP-polymer which has been tested and approved for foodstuff packaging purposes by the FDA of the USA.

The composite which is made by more or less conventional methods, preferably in a continuous process, is processed to the body and possibly into the bottom of a can.

For the manufacture of the can body, the composite can be cut into endless strips, the width of which corresponds to the circumference plus the overlap at the weld. This is then shaped into a tube and welded along the length in a conventional manner. In the case of version (b) PP is welded to PP. In version (a) the overlapping brings the aluminum foils on top of each other. Preferably wedge shaped welding tool, or additional material (plastic-welding rod) is then used. The composite is made during its manufacture e.g. such that the aluminum foil, which is on the outside of the tube later, projects out 1 to 10 mm beyond the plastic core and carries adhesive on it, so that this part covers the weld seam and ensures that the permeable weld in the plastic is air-tight and the appearance is improved. The body tubing made this way is cut into lengths corresponding to the height of the can.

The body can however also be manufactured such that a piece can be cut out of the composite and then shaped into the form of a can body by welding it longitudinally. This makes it then possible to make a conical body i.e. one in which the cross section is different at both ends.

Such a tubular body usually has a circular cross section because of the elastic properties of the material used. By choosing the appropriate shape of lid and bottom for the can it is possible—simply and without any special manufacturing steps—to make the cross section in another form e.g. elliptical, oval or n-sided ($n=2$ and more). It is also possible, without difficulty, to choose different shapes for the bottom and the lid. Furthermore, it should be mentioned that it is also possible and within the scope of the invention, when using a body 2 as described in version (a) above, to flange a metal bottom together with the edge of the body at one end, as required.

What is claimed is:

1. A can particularly suitable for preserving foodstuffs comprising a body which is basically cylindrical in shape and top and bottom parts fixed to the said can body, wherein the can body is made of an aluminum-plastic composite and is permanently affixed at one end directly to said bottom part and at the other end of said top part via a metal ring which is adhesively secured to said can body and flanged only to said top part.

2. A can according to claim 1 wherein the metal ring is provided with a series of holes whereby molten material from the can body flows into and sets in said holes.

3. A can according to claim 1 wherein the metal ring is provided with at least one bulge around its periphery which forms a channel when the ring is mounted on the can body, said channel being filled with a material which adheres to both the ring and can body.

4. A can according to claim 1 wherein said can bottom is made of metal and is secured to the edge of the can body.

5. A can according to claim 1 wherein said bottom is made of a composite material.

6. A can according to claim 5 wherein said bottom is deep drawn and welded to the can body.

7. A can according to claim 1 wherein a flat can bottom fitting the inner contour of the can is welded into the interior of the can body by means of a toroidal shaped weld bead.

8. A can according to claim 1 wherein the aluminum-plastic composite of the can body is less than 1 mm thick.

9. A can according to claim 8 wherein the aluminum component of said aluminum-plastic composite does not exceed 0.1 mm in thickness.

10. A can according to claim 1 wherein said aluminum-plastic composite is aluminum coated on both sides with plastic.

11. A can according to claim 10 wherein said aluminum-plastic composite is aluminum from 20 to 100 $\mu$m in thickness coated on both sides with polypropylene from 100 to 500 $\mu$m in thickness.

12. A can according to claim 1 wherein said aluminum-plastic composite is plastic coated on both sides with aluminum.

13. A can according to claim 12 wherein said body has a joining seam and is characterized by the aluminum component projecting out beyond the plastic core so that the projecting part covers the seam and insures an air-tight container.

14. A can according to claim 13 wherein the aluminum component projects out 1 to 10 mm beyond the plastic core.

15. A process for manufacturing a can having a cylindrical body part and top and bottom parts affixed thereto in which the combination of the following steps is employed:

(a) providing said body made out of an aluminum-plastic composite;

(b) affixing a metal ring to one end of the body only by means of an adhesive and the application of pressure and elevated temperature to produce welding or sealing; and (c) securing said metal ring to said top part by flanging.

16. A process according to claim 15 wherein material of the can body is melted in holes in the metal ring and then solidified to anchor the ring to the can body.

17. A process according to claim 15 wherein material of the can body is melted in a channel formed by the metal ring around the can body and then solidified to anchor the ring to the body.

18. A process according to claim 15 wherein said top part is a lid and wherein said metal ring is flanged only thereto.

19. A process according to claim 15 wherein said cylindrical body part is formed from a strip of said aluminum-plastic composite shaped and formed together at a seam into a tube-like configuration, wherein the aluminum component projects out beyond the plastic so that the projecting part covers the seam and insures an air-tight container.

20. A process according to claim 19 wherein the aluminum component projects out 1 to 10 mm beyond the plastic core.

* * * * *

UNITED STATES PATENT AND TRADEMARK OFFICE

CERTIFICATE OF CORRECTION

PATENT NO. : 4,223,798

DATED : September 23, 1980

INVENTOR(S) : Jean Schrade

It is certified that error appears in the above-identified patent and that said Letters Patent are hereby corrected as shown below:

In Column 1, line 35, change "not" to read ---now---.

In Column 1, line 65, change "cans" to read ---can---.

In Column 2, line 46, change "of", second occurrence, to read ---for---.

In Column 5, line 1, claim 1, after "end" change "of" to read ---to---.

Signed and Sealed this

*Thirteenth* Day of *January 1981*

[SEAL]

*Attest:*

SIDNEY A. DIAMOND

*Attesting Officer*

*Commissioner of Patents and Trademarks*